US005947168A

United States Patent [19]

Viard

[11] Patent Number: 5,947,168

[45] Date of Patent: Sep. 7, 1999

[54] METHOD AND APPARATUS FOR RAPIDLY DEFLATING AND SUBSTANTIALLY TOTALLY EMPTYING AN INFLATABLE CHAMBER, IN PARTICULAR A CHAMBER OF A SUPPORT DEVICE, SUCH AS A MATTRESS

[75] Inventor: Jean-Louis Viard, Grabels, France

[73] Assignee: Support Systems International Industries, Montpellier Cedex 5, France

[21] Appl. No.: 09/044,635

[22] Filed: Mar. 19, 1998

[30] Foreign Application Priority Data

Mar. 19, 1997 [FR] France ..... 97-03331

[51] Int. Cl.[6] ..... B65B 1/04

[52] U.S. Cl. ..... 141/1; 141/4; 141/7; 141/10; 141/65; 141/66; 141/67; 141/68; 141/114; 141/313; 141/317; 5/713

[58] Field of Search ..... 141/7, 4, 10, 65–68, 141/114, 192, 197, 285, 289, 290, 301, 302, 307, 312–314, 317, 1; 5/713, 714, 715; 128/845, 846, 870

[56] References Cited

U.S. PATENT DOCUMENTS

| | | | |
|---|---|---|---|
| 4,944,060 | 7/1990 | Peery et al. | 5/713 |
| 5,454,407 | 10/1995 | Huza et al. | 141/10 |
| 5,806,572 | 9/1998 | Voller | 141/10 |

*Primary Examiner*—Henry J. Recla
*Assistant Examiner*—Timothy L. Maust
*Attorney, Agent, or Firm*—Wolf, Greenfield & Sacks, P.C.

[57] ABSTRACT

A method and apparatus for rapidly deflating a chamber. The apparatus for rapidly inflating an inflatable chamber of determined inflation volume with an inflation fluid comprises an inflation device for inflating said inflatable chamber with an inflation fluid to a predetermined inflation pressure, and further comprises a rapid deflation device for rapidly deflating said chamber by sucking out said inflation fluid at a high flow rate, the rapid deflation device being used on deactivating said chamber, in particular so as to transport it with its volume being reduced to as small as possible.

21 Claims, 3 Drawing Sheets

METHOD AND APPARATUS FOR RAPIDLY DEFLATING AND SUBSTANTIALLY TOTALLY EMPTYING AN INFLATABLE CHAMBER, IN PARTICULAR A CHAMBER OF A SUPPORT DEVICE, SUCH AS A MATTRESS

The invention relates essentially to a method and to apparatus for rapidly deflating and substantially totally emptying an inflatable chamber, in particular a chamber of a support device, such as a mattress. The invention may be particularly advantageously applied to preventing and treating complications related to long periods of being confined to bed and of being kept still, and in particular bedsores.

BACKGROUND OF THE INVENTION

The prior art, and in particular the Applicant's prior document FR-A-2 718 347=EP-A-676 158, discloses a method and a device for supporting an element to be supported, in particular the body of a patient, making it possible to support the element at an essentially constant controlled penetration depth.

Unfortunately, in the prior art, such inflatable chambers, a preferred application of which is to therapeutic surfaces, pose a problem when they are to be transported. To make them easier to carry, their volume must be reduced to as small as possible while touching them as little as possible, in view of the risks of possible contamination.

To reduce their volume, substantially all of the air that they contain must be removed. The most commonly used technique for removing the air is to roll the mattress up, or to press on the entire surface of the mattress. Such touching for emptying purposes can give rise to contamination, that risk being particularly great when emptying a therapeutic mattress which might have been used by a patient suffering from a contagious disease. In addition, it takes a relatively long time to reduce its volume in that way.

However, prior to the invention, no one posed the problem of emptying an inflatable chamber rapidly and substantially totally, in particular a chamber of a support device, such as a mattress.

OBJECTS AND SUMMARY OF THE INVENTION

Thus a main object of the present invention is to solve the new technical problem consisting in providing a solution that makes it possible to reduce the volume of an inflatable chamber to as small as possible in a relatively short time, in particular a chamber of a support device, such as a mattress.

Another main object of the invention is to solve the above-mentioned new technical problem using a solution that makes it possible to achieve the reduction in the volume of an inflatable chamber in less than 10 minutes, preferably in less than 5 minutes, and better still in less than about 2 minutes.

Another main object of the invention is to solve the above-mentioned new technical problem by providing a solution that makes it possible to avoid any contamination of the technical or nursing staff, i.e. by avoiding or eliminating any direct contact between the technical or nursing staff and the inflatable chamber, in particular a chamber of a support device, such as a mattress, and advantageously a therapeutic mattress.

All of these technical problems are solved for the first time by the present invention in a manner that is simple, cheap, and easy to implement, and that can be used industrially and medically.

Thus, in a first aspect, the present invention provides a method of rapidly reducing the volume of an inflatable chamber that can be inflated with an inflation fluid, said chamber having a given inflation volume, said method comprising a prior step of inflating the chamber to a predetermined inflation pressure, wherein, on deactivating the inflatable chamber, in particular so as to transport it, the chamber is deflated rapidly by sucking out the inflation fluid present in said chamber at a high flow rate for a period of time that is long enough to remove substantially all of the inflation fluid from said chamber, thereby reducing the volume of said inflatable chamber in the deflated state to as small as possible.

In an advantageous implementation of the method of the invention, said chamber is part of a support device, in particular a device for supporting the body of a patient, said support device preferably comprising a mattress.

In an advantageous implementation of the method of the invention, the high flow rate serving to deflate the chamber rapidly is implemented at a flow rate of not less than 50 liters per minute (l/min), better still not less than 100 l/min, preferably greater than 200 l/min, and more preferably greater than 300 l/min.

In yet another advantageous implementation of the invention, the deflation at a high flow rate is implemented at a low pressure which may be lower than about 20 mbars.

In yet another advantageous implementation of the invention, the total duration of the deflation of the chamber is not more than about 10 minutes, preferably not more than about 5 minutes, better still less than about 2 minutes, and in particular about 1 minute.

The present invention is particularly advantageously applicable in the context of a method of supporting an element to be supported, in particular the body of a patient, the method comprising providing at least one support device comprising at least one closed or controlled-release chamber that is flexible and inflatable, filling and emptying means and filling and emptying control means being provided for filling said chamber with a filling fluid and emptying said fluid therefrom as a function of various chosen parameters, in particular the penetration distance to which an element to be supported such as the body of a patient penetrates into the support element comprising said chamber, and/or the inflation pressure in said chamber, said method further comprising rapid deflation means for sucking out the inflation fluid at a high flow rate.

Incidentally, it should be noted that the parameters for adjusting the penetration distance or the inflation pressure in the chamber are well known to a person skilled in the art, and, in particular when supporting a patient, they make it possible to achieve expected performance levels as regards giving the patient preventive or other treatment, in particular when preventing or treating complications, in particular bedsores, related to the patient being confined to bed or kept still for prolonged periods, and to avoid relatively high pressures on the various portions of the element to be supported, in particular the body of a patient, such pressures being harmful to the treatment and to the comfort of certain types of patient, in particular patients who have undergone skin grafts or patients who suffer acute pain consequent upon certain diseases.

In the context of the invention, the method aims more particularly to reduce the volume of the support device, and in particular the inflatable chamber, to obtain a volume that is as small as possible, and to do so without touching it.

In a second aspect, the present invention also provides apparatus for rapidly inflating an inflatable chamber with an inflation fluid, said chamber having a determined inflation volume, said apparatus comprising inflation means for inflating said inflatable chamber with an inflation fluid to a predetermined inflation pressure, said apparatus further comprising rapid deflation means for rapidly deflating said chamber by sucking out said inflation fluid at a high flow rate, the rapid deflation means being used on deactivating said chamber, in particular so as to transport it with its volume being reduced to as small as possible.

In a particularly advantageous embodiment of the invention, said rapid deflation means for deflating the chamber rapidly at a high flow rate comprise at least one turbine or miniturbine, e.g. delivering a flow rate of not less than 50 l/min, better still not less than 100 l/min, even better still not less than 200 l/min, and preferably greater than 300 l/min.

In yet another advantageous embodiment of the invention, the rapid deflation means are controlled by control means which may advantageously comprise a control station usually comprising an electronic, electromechanical, or electropneumatic processing unit managing automatic operation of deflation of the chamber by said deflation means. Such control means are well known to a person skilled in the art, and they are not described in any further detail herein. They are generally of the type of those described in the Applicant's prior document FR-A-2 718 347=EP-A-0 676 158 to which a person skilled in the art may refer.

In another particularly advantageous embodiment of the invention, said rapid deflation means may be at least temporarily connectable to the feed tube via which the inflatable chamber is fed with inflation fluid, such connection taking place at the suction inlet of the deflation means, e.g. at the suction inlet of a turbine or miniturbine, which constitutes the currently preferred deflation means. In the context of this embodiment, the rapid deflation means are then caused to operate until essentially all of the inflation fluid contained in the inflatable chamber has been sucked out.

In the context of the invention, it is preferable for the inflation fluid with which the chamber is inflated to be air, but naturally it is possible to use a liquid such as water or an aqueous solution.

In another particularly advantageous embodiment of the invention, it is also possible to provide rapid deflation means that are organized to serve also to inflate said inflatable chamber, the same means thus being used both for inflating and for deflating the inflatable chamber rapidly, merely by modifying the connection configuration of the feed duct via which the inflatable chamber is fed with inflation fluid as can be well understood by a person skilled in the art, and as can be easily understood with reference to FIGS. 2 and 3, which are explained below.

In a currently preferred embodiment of the invention, the apparatus comprises single pumping means serving both to inflate and to deflate said inflatable chamber, the single means being provided with an inlet via which inflation fluid is fed either from an inflation fluid supply, in the chamber inflation position, or from the chamber, in the chamber deflation position, and with an outlet via which inflation fluid is delivered either to the feed duct via which the chamber is fed with inflation fluid, in the chamber inflation position, or to the inflation fluid supply or to the surrounding atmosphere, in the chamber deflation position.

In the latter embodiment, the single rapid deflation and inflation means comprise a turbine or miniturbine provided with two inflation fluid access paths, namely one access path from the inflation fluid supply, and another access path from the inflatable chamber, and with two outlet paths, namely one outlet path at least temporarily in communication with the inflatable chamber, and one outlet path at least temporarily in communication with the fluid supply or with the surrounding atmosphere.

In a currently preferred embodiment in which the fluid is constituted by air, the fluid supply is in fact constituted by the surrounding atmosphere.

In a particular variant embodiment, the two access paths to the turbine or miniturbine may be constituted firstly by a normal main connection path for connecting to the fluid supply, in particular the surrounding atmosphere, and a secondary access path comprising, for example, a venturi system temporarily communicating with the feed pipe of the inflatable chamber via means for enabling or disabling the communication, such as a valve, depending on whether said chamber is to be inflated or deflated rapidly.

It can thus be understood that, by means of the invention, the inflatable chamber can be deflated rapidly and substantially totally without any physical contact with the inflatable chamber, in a very short time, less than 10 minutes, advantageously less than 5 minutes, better still less than 2 minutes, and ideally about 1 minute.

It can be understood that the invention makes it possible to solve the above-mentioned technical problems in a manner that is simple, cheap, easy to implement, and that can be used industrially and medically.

The invention also makes it possible to deflate any type of chamber rapidly, and in particular chambers in a support device, in particular a device for supporting the body of a patient.

In the context of the invention, the support device or mattress may comprise a multitude of cushions or tubes that communicate with one another, or that communicate with one another only over certain zones, thereby making it possible to define zones that are inflated to different pressures.

Furthermore, in another embodiment, the cushions or tubes may be deflated individually alternately and sequentially, in particular every other tube, one in three tubes, one in four tubes, or one in n tubes by distinct deflation means which preferably consist generally of a release valve leading to the surrounding air.

In the context of the invention, the rapid deflation means are organized to deflate by removing substantially all of the inflation fluid, in particular air, which is not achieved by conventional deflation that operates merely by releasing the air in the chamber to the surrounding air.

It can thus be understood that the invention is also applicable to any type of inflatable chamber.

BRIEF DESCRIPTION OF THE DRAWINGS

Other objects, characteristics, and advantages of the invention appear clearly on reading the following explanatory description made with reference to currently-preferred embodiments of the invention given merely by way of illustration, and therefore in no way limiting the scope of the invention. It should be noted that any characteristic that appears to be novel compared with any prior art is part of the invention in its general principle, i.e. as general means, on the basis of the description as a whole. Therefore, accompanying

In the figures:

FIG. 1 is a diagrammatic view showing the principle of rapiddeflation apparatus of the present invention, in a first embodiment in which the inflatable chamber is an inflatable chamber of a support element for supporting an element to be supported such as the body of a patient, the support element then being of the mattress type;

FIGS. 2 and 3 show a second embodiment of the present invention with fluid-pumping means serving alternately for rapid inflation (FIG. 2) and for rapid deflation (FIG. 3); and FIGS. 4 and 5 show a currently-preferred third embodiment of apparatus of the present invention, also comprising single fluid-pumping means, using an automatically-controlled fluid flow circuit, the rapid inflation position of the circuits being shown in FIG. 4, and the rapid deflation position being shown in FIG. 5.

MORE DETAILED DESCRIPTION

Figure 1:
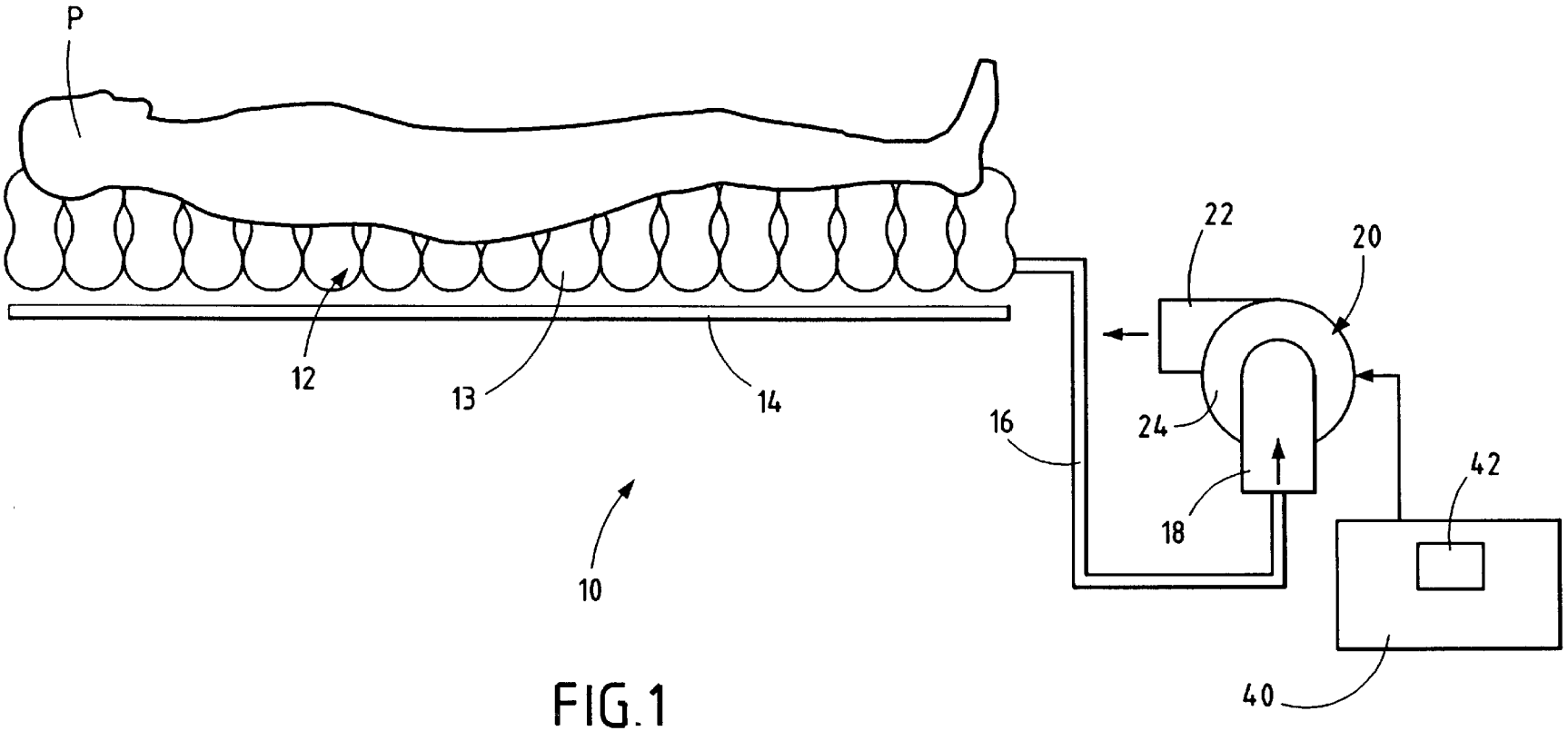
FIGS. 1 to 5 are integral parts of the present invention.

In FIG. 1, a first embodiment of apparatus of the present invention is given the overall reference 10.

This apparatus comprises a support device proper 12 comprising, for example, at least one closed or controlled-release zone 13 that is flexible and inflatable, and that may, for example, be made up of a multitude of inflatable tubes that communicate with one another. This chamber 13 is inflatable under an initial inflation pressure that is predetermined and adjustable. The support device 12 generally rests on a base 14 or equivalent means.

Naturally, the support device 12 may be subdivided into a plurality of inflatable chambers, each of which can thus be inflated to an initial inflation pressure that is predetermined and different from the initial inflation pressures of the other chambers.

Advantageously, the apparatus 10 further comprises control means 40 which advantageously comprise a control station 42 usually comprising an electronic, electro-mechanical, or electro-pneumatic central processing unit for managing automatic operation of inflation of the chamber 13. Such control means 40 are well known to a person skilled in the art, and they are not described in any further detail herein. They are generally of the type of those described in the Applicant's prior document FR-A-2 718 347=EP-A-0 676 158 to which a person skilled in the art may refer.

In the context of the present invention, and as shown in FIG. 1, when, at the end of the treatment of the patient P, the chamber 13 is to be deflated rapidly and emptied essentially totally, the feed pipe 16 via which the inflation fluid is fed into the chamber 13 is connected to the inlet 18 of the deflation means 20, as shown, the outlet 22 of the deflation means 20 being connected to a fluid supply. It can be understood that, when the fluid is air, the outlet 22 is connected directly to the surrounding atmosphere, as shown. Advantageously, the deflation means 20 comprises a turbine or miniturbine 24 performing deflation at a high flow rate and, in general, at a low pressure. Such turbines or miniturbines 24 are well known to a person skilled in the art, and they are commercially available. They are generally capable of delivering flow rates higher than 200 liters per minute (l/min), in particular about 350 l/min at a low pressure of about 8 mbars. In this case, pressure is of no importance during deflation.

As a result of the presence of the deflation means, it is possible to deflate the entire volume of the chamber 13 very rapidly, i.e., in general, in about 1 minute, so that the support device (a mattress in this case) takes up an extremely small volume. This reduction in volume is achieved without touching the support device 12, thereby enabling it to be stored in a small volume, and enabling it to be transported easily, without any risk of contaminating technical or nursing staff.

Figure 2:
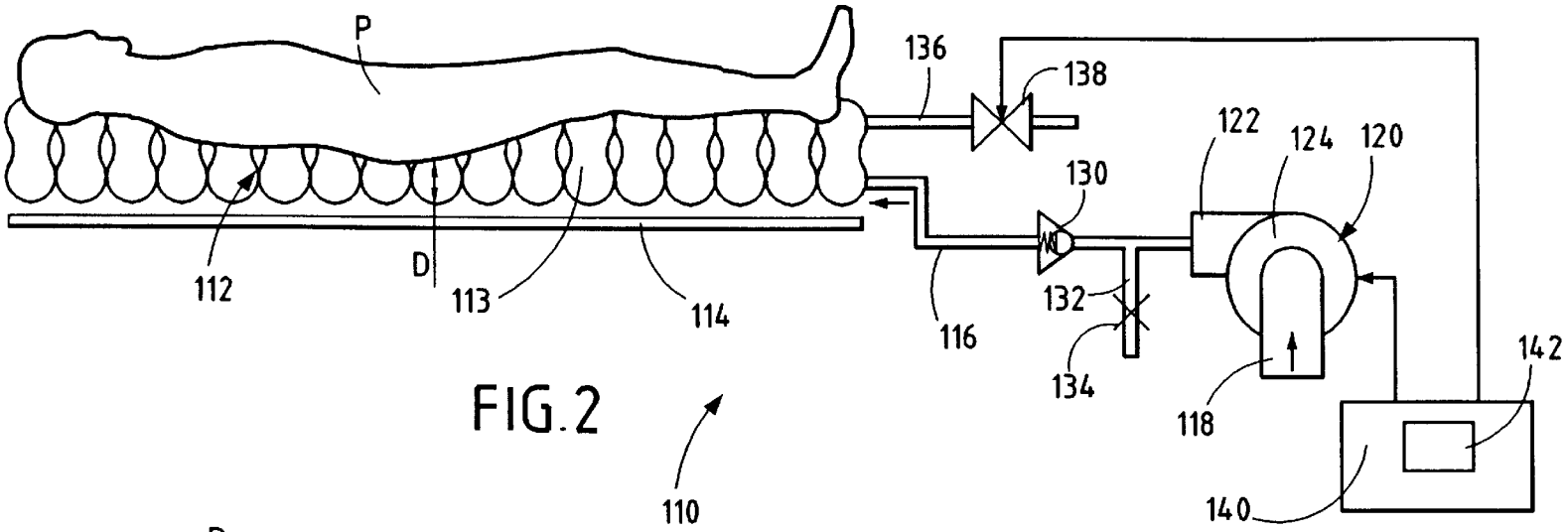
Figure 3:
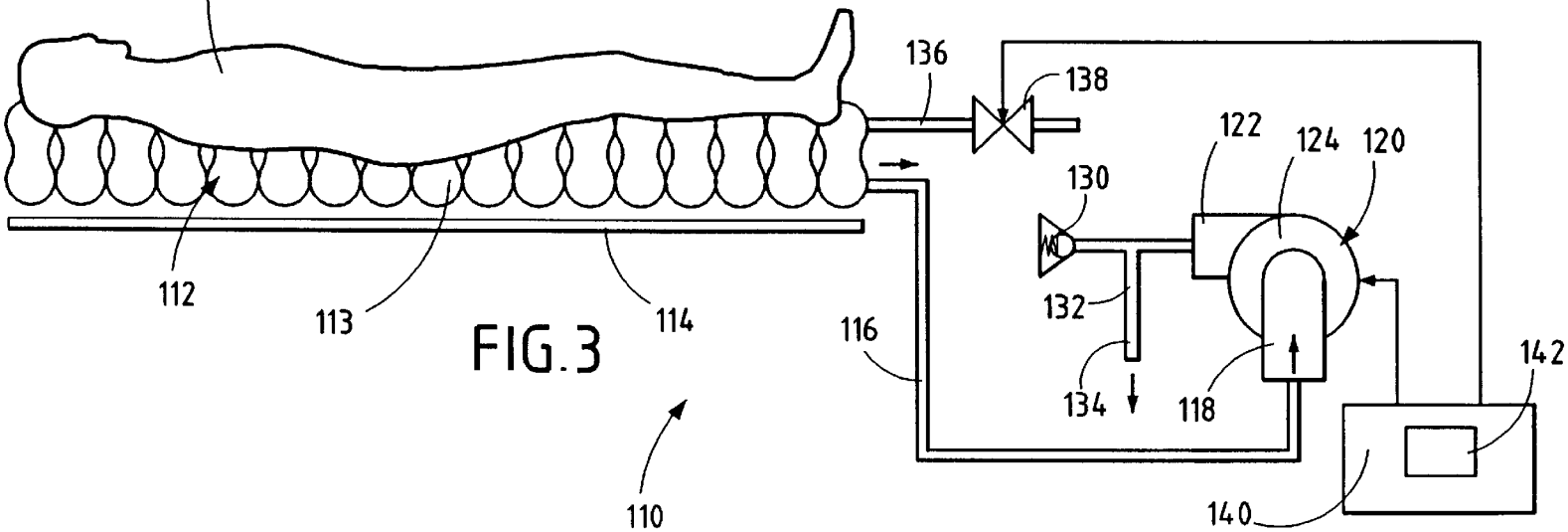

FIGS. 2 and 3 show a second embodiment of apparatus of the present invention for which the same reference numerals are used as in the FIG. 1 embodiment, except that they are increased by 100, for identical portions or portions having the same function. Thus, the apparatus has the overall reference 110, the support device has the overall reference 112, the chamber is referenced 113, the base 114, the inflation fluid feed pipe 116, the control means 140, and the control station 142.

In a second embodiment, the apparatus 110 comprises single inflation-fluid pumping means 120 which can operate either in inflation mode in which they inflate the chamber 113, as shown in FIG. 2, or in deflation mode in which they deflate the chamber 113, as shown in FIG. 3, by merely modifying the connection configuration of the feed pipe 116 of the chamber 113 so that it is connected either to the inlet 118 or to the outlet 122, as can be well understood by a person skilled in the art, and as is explained in more detail below.

Furthermore, on the feed pipe 116, the apparatus 110 also comprises a non-return valve 130, e.g. rated at a few millibars. On the pipe 116, between the outlet 122 and the non-return valve 130, a branch pipe 132 is provided that constitutes temporary communication means for temporarily communicating with the surrounding atmosphere or with an inflation fluid supply, depending on whether or not the fluid is constituted by air, the communication means comprising means such as a valve 134 making it possible, when so desired, i.e. as shown in FIG. 3, to put the outlet 122 of the pumping means 120 in communication with the surrounding atmosphere or with an inflation fluid supply.

In addition, the chamber 113 may also communicate at least temporarily with the surrounding atmosphere or with an inflation fluid supply via a pipe 136 provided with temporary opening means 138 such as a valve controlled electronically, electro-mechanically, or electro-pneumatically by the control means 140 and their control station 142, as indicated by the corresponding arrows in FIG. 2.

It can thus be understood that with the circuit configuration shown in FIG. 2, the control means 140 with their control station 142 can cause the pumping means 120, such as a turbine or a miniturbine, to inflate the chamber 113 rapidly initially to the desired predetermined inflation pressure. In addition, while the patient P is being supported on the support device 112, it is possible to regulate the pressure in the chamber 113 as a function of a desired penetration distance D, or of the inflation pressure in the chamber 113 as is well known to a person skilled in the art, and as is disclosed, in particular, by the Applicant's prior document FR-A-2 718 347=EP-A-0 676 158 to which a person skilled in the art may refer. In that context, by temporarily opening the opening means 138, such as a valve, it is possible to deflate the chamber 113 in controlled and limited manner so as to regulate the penetration distance D to which the patient P penetrates into the support device 112, or so as to obtain a predetermined inflation pressure in the chamber 113.

In the context of the invention, when the mattress is to be rapidly and fully deflated, involving emptying the chamber 113 substantially totally, the structural modification shown in FIG. 3 is performed, namely, the feed pipe 116 of the chamber 113 is disconnected from the non-return means 130 so as to be connected to the inlet 118 of the pumping means 120. In addition, the temporary communication means 134 are then opened. As a result, on starting up the pumping means 120, the inflation fluid contained in the chamber 113 is pumped out rapidly via the branch pipe 132 either into the surrounding atmosphere when said fluid is air or a gas compatible with the atmosphere, e.g. nitrogen, or else into an inflation fluid supply when the fluid is to be kept and reused.

In this way, total deflation, involving removing substantially all of the inflation fluid from the chamber 113, is achieved in an extremely short time, as in the example shown in FIG. 1, without much touching of the device being necessary, and without having to touch the support device 112 defining the chamber 113, for the purposes of stowing or transporting it, thereby limiting or avoiding contamination of technical or nursing staff.

Figure 4:
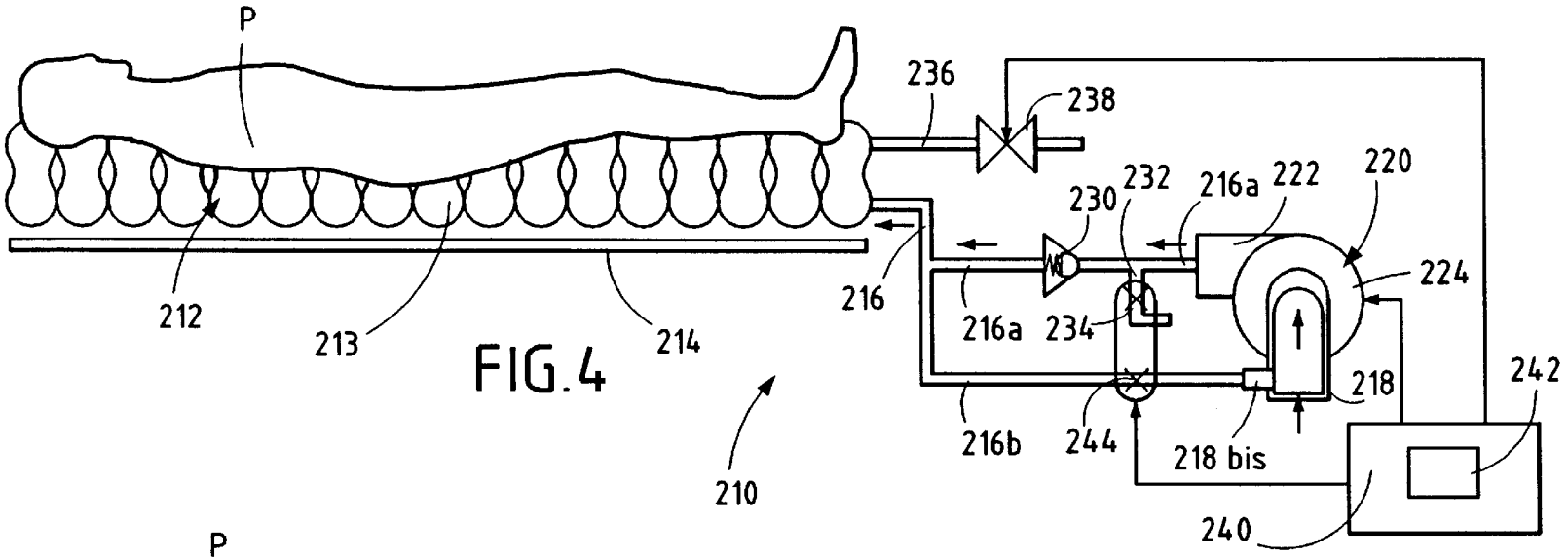
Figure 5:
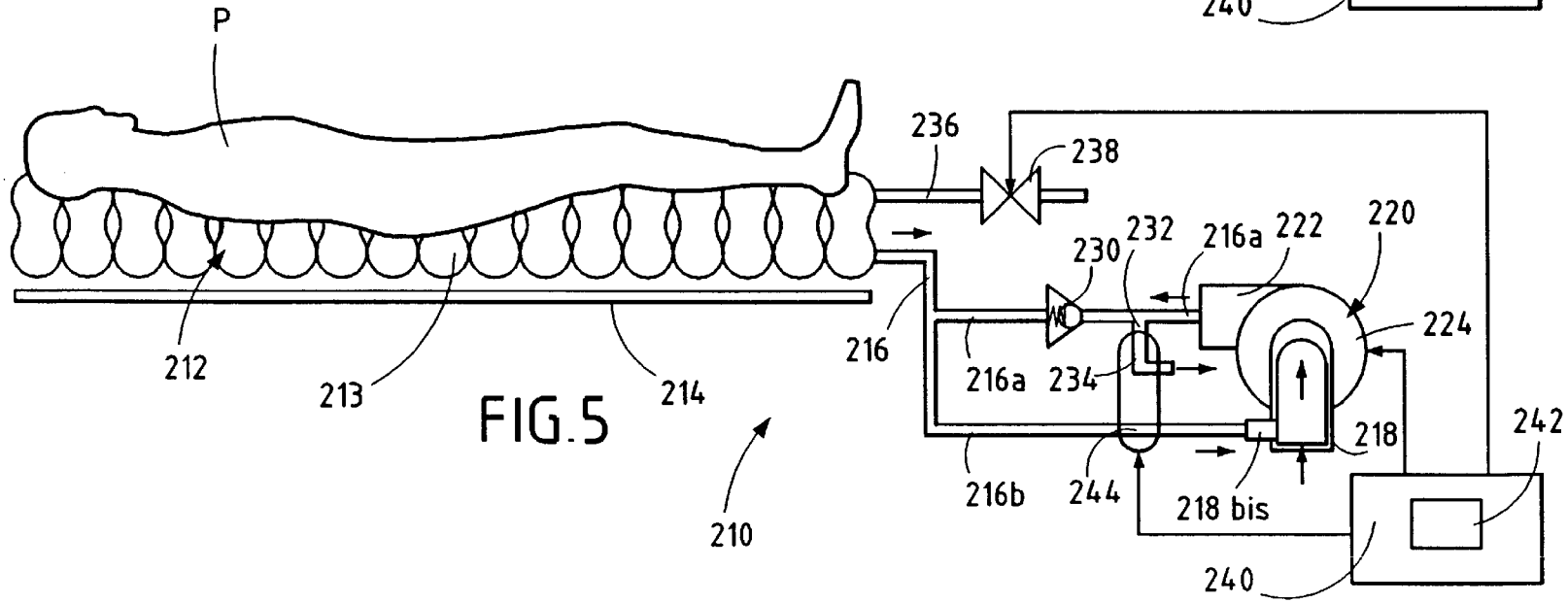

FIGS. 4 and 5 show a third embodiment of apparatus of the present invention, for which the reference numerals are increased by a further 100. Thus, the apparatus has the overall reference 210, the support device has the reference 212, the chamber has the reference 213, etc. The embodiment shown in FIGS. 4 and 5 constitutes a variant of the embodiment shown in FIGS. 2 and 3, this variant being currently preferred. In this context, it can be observed that the modifications lie in the feed pipe 216 for feeding the chamber 213 with inflation fluid being subdivided into a first subdivision 216*a* connected to the non-return means 230 themselves connected to the outlet 222 of the pumping means 220, and a second branch 216*b* connected at least temporarily by temporary communication means 244, such as a valve, to a second inlet 218*b*is branching off from the main inlet 218 of the pumping means 220. The branch second inlet 218*b*is may, for example, comprise a venturi.

It can be understood that, when the temporary communication means 244 are closed, the branch second inlet 218*b*is does not operate, the second inlet coming into action only when the temporary communication means 244 are open. The communication means 244 may be constituted merely be a valve. In the context of the invention, the temporary communication means 244 are combined with the temporary communication means 234 mounted on the branch 232 of the pipe portion 216*a* serving to feed the inflatable chamber 213 with inflation fluid. In the context of the invention, the temporary communication means 234 and 244 may be closed simultaneously as shown in FIG. 4, thereby making it possible, while the pumping means 220 are pumping, to inflate or to regulate the inflation of the chamber 213, or they may be opened simultaneously as shown in FIG. 5, thereby making it possible for the chamber 213 to be deflated and substantially totally emptied, as can be well understood by a person skilled in the art on inspecting FIG. 5. As a result, the means 234 and 244 effectively constitute single means that can be controlled very simply manually or electronically, electro-magnetically, or electro-pneumatically by the control station 242 and the control means 240.

Therefore, it is easy for the configuration shown in FIG. 4 to be caused to inflate the chamber and to regulate inflation thereof by acting on the control means 240 and on the control station 242, while the automatically modified configuration shown in FIG. 5 can be caused to deflate and substantially totally empty the chamber 213 merely by automatically causing the temporary communication means 234 and 244 to be opened simultaneously.

It can be understood that the invention thus makes it possible to achieve rapid deflation by means of a single command, without connecting/disconnecting feed tubes for feeding the inflatable chamber 213.

I claim:

1. A method of rapidly reducing the volume of an inflatable chamber of a mattress of a device for supporting the body of a patient that can be inflated with an inflation fluid, said chamber having a given inflation volume, said method comprising a prior step of inflating the chamber to a predetermined inflation pressure, wherein, on deactivating the inflatable chamber, in particular so as to transport it, the chamber is deflated rapidly by a deflating means sucking out the inflation fluid present in said chamber at a high flow rate for a period of time that is long enough to remove substantially all of the inflation fluid from said chamber, thereby reducing the volume of said inflatable chamber in the deflated state to as small as possible.

2. The method of claim 1, wherein the high flow rate serving to deflate the chamber rapidly is implemented at a flow rate of not less than 50 liters per minute.

3. The method of claim 1, wherein the high flow rate serving to deflate the chamber rapidly is implemented at a flow rate of not less than 100 liters per minute.

4. The method of claim 1, wherein the high flow rate serving to deflate the chamber rapidly is implemented at a flow rate of greater than 200 liters per minute.

5. The method of claim 1, wherein the high flow rate serving to deflate the chamber rapidly is implemented at a flow rate of greater than 300 liters per minute.

6. The method of claim 1, wherein said deflation at a high flow rate is implemented at a low pressure which may be lower than about 20 mbars.

7. The method of claim 1, wherein the total duration of the deflation of the chamber is not more than about 10 minutes.

8. The method of claim 1, wherein the total duration of the deflation of the chamber is not more than about 5 minutes.

9. The method of claim 1, wherein the total duration of the deflation of the chamber is less than about 2 minutes.

10. The method of claim 1, wherein the total duration of the deflation of the chamber is of about 1 minute.

11. Apparatus for rapidly inflating an inflatable chamber of a mattress of a device for supporting the body of a patient with an inflation fluid, said chamber having a determined inflation volume, said apparatus comprising inflation means for inflating said inflatable chamber with an inflation fluid to a predetermined inflation pressure, said apparatus further comprising rapid deflation means for rapidly deflating said chamber by sucking out said inflation fluid at a high flow rate, the rapid deflation means being used on deactivating said chamber, in particular so as to transport it with its volume being reduced to as small as possible.

12. The apparatus of claim 11, wherein said rapid deflation means for deflating the chamber rapidly at a high flow rate comprise at least one turbine or miniturbine, delivering a flow rate of not less than 50 liters per minute.

13. The apparatus of claim 11, wherein said rapid deflation means for deflating the chamber rapidly at a high flow rate comprise at least one turbine or miniturbine, delivering a flow rate of not less than 100 liters per minute.

14. The apparatus of claim 11, wherein said rapid deflation means for deflating the chamber rapidly at a high flow rate comprise at least one turbine or miniturbine, delivering a flow rate not less than 200 liters per minute.

15. The apparatus of claim 11, wherein said rapid deflation means for deflating the chamber rapidly at a high flow rate comprise at least one turbine or miniturbine, delivering a flow rate greater than 300 liters per minute.

16. The apparatus of claim 11, wherein the rapid deflation means are controlled by control means which comprise a control station comprising an electronic, electromechanical, or electro-pneumatic processing unit managing automatic operation of deflation of the chamber by said deflation means.

17. The apparatus of claim 11, wherein said rapid deflation means is at least temporarily connectable to the feed tube via which the inflatable chamber is fed with inflation fluid, at the suction inlet of the deflation means.

18. The apparatus of claim 13, wherein the rapid deflation means are organized to serve also to inflate said inflatable chamber, thereby constituting single pumping means, the same means thus being used both for inflating and for deflating the inflatable chamber rapidly, merely by modifying the connection configuration of the feed duct via which the inflatable chamber is fed with inflation fluid.

19. The apparatus of claim 11, comprising single pumping means serving both to inflate and to deflate said inflatable chamber, the single means being provided with an inlet via which inflation fluid is fed in either from an inflation fluid supply, in the chamber inflation position, or from the chamber, in the chamber deflation position, and with an outlet via which inflation fluid is delivered either to the feed duct via which the chamber is fed with inflation fluid, in the chamber inflation position, or to the inflation fluid supply or to the surrounding atmosphere, in the chamber deflation position.

20. The apparatus of claim 18, wherein the pumping means are provided with a main inlet, and with a branch inlet.

21. The apparatus of claim 19, wherein said branch inlet comprises a venturi.

* * * * *